US007914124B2

(12) United States Patent
Seshimo et al.

(10) Patent No.: US 7,914,124 B2
(45) Date of Patent: Mar. 29, 2011

(54) LIQUID SUPPLYING DEVICE AND LIQUID EJECTION APPARATUS

(75) Inventors: Tatsuya Seshimo, Asahi-mura (JP); Takeshi Fujishiro, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 1016 days.

(21) Appl. No.: 11/729,028

(22) Filed: Mar. 27, 2007

(65) Prior Publication Data

US 2007/0222834 A1 Sep. 27, 2007

(30) Foreign Application Priority Data

Mar. 27, 2006 (JP) ..... 2006-085703

(51) Int. Cl.
*B41J 2/05* (2006.01)

(52) U.S. Cl. ..... 347/66; 347/85

(58) Field of Classification Search ..... 347/47, 347/66, 84, 85; 141/2, 18
See application file for complete search history.

(56) References Cited

U.S. PATENT DOCUMENTS 7,156,507 B2 * 1/2007 Aruga et al. ..... 347/85
7,163,282 B2 * 1/2007 Kumagai et al. ..... 347/85
7,164,436 B2 * 1/2007 Kumagai et al. ..... 348/85
7,303,271 B2 * 12/2007 Shimizu et al. ..... 347/94
7,500,618 B2 3/2009 Fujishiro et al.

FOREIGN PATENT DOCUMENTS

| | | | |
|---|---|---|---|
| JP | 63185471 | A | 8/1988 |
| JP | 1269546 | A | 10/1989 |
| JP | 2004114516 | A | 4/2004 |
| JP | 2004-268351 | A | 9/2004 |
| JP | 2005-095861 | | 4/2005 |
| JP | 2005-131791 | A | 5/2005 |
| JP | 2005-186344 | | 7/2005 |
| JP | 2005-195117 | | 7/2005 |
| JP | 2005343123 | A | 12/2005 |

* cited by examiner

*Primary Examiner* — Anh T. N. Vo
(74) *Attorney, Agent, or Firm* — Nutter McClennen & Fish LLP; John J. Penny, Jr.; Michael P. Visconti, III

(57) ABSTRACT

A valve unit supplies ink supplied from a plurality of ink cartridges to a recording head. The recording head includes a plurality of nozzle rows respectively corresponding to the plurality of ink cartridges. The valve unit includes a plurality of liquid supply passages and at least one flow passage formation body. Each liquid supply passage supplies the ink supplied from the corresponding ink cartridge to the corresponding nozzle row. Each liquid supply passage includes a common portion functionally in common with another liquid supply passage. The common structure of the plurality of liquid supply passages is formed in the same flow passage formation body.

1 Claim, 11 Drawing Sheets

LIQUID SUPPLYING DEVICE AND LIQUID EJECTION APPARATUS

CROSS-REFERENCE TO RELATED APPLICATIONS

This application is based upon and claims the benefit of priority from prior Japanese Patent Application No. 2006-085703, filed on Mar. 27, 2006, the entire contents of which are incorporated herein by reference.

BACKGROUND

1. Technical Field

The present invention relates to a liquid supplying device and a liquid ejection apparatus.

2. Related Art

An ink jet printer (hereinafter referred to as a printer) is widely known as a liquid ejection apparatus for ejecting liquid onto a target. The printer has a recording head (liquid ejection head) mounted on a carriage that reciprocates. The recording head is supplied with ink (liquid) from an ink cartridge (liquid container) mounted on the printer at a predetermined location. The ink is ejected to a paper, which serves as a target, from a nozzle formed in a nozzle formation surface of the recording head to perform printing.

Such a printer is disclosed in, for example, JP-A-2005-95861. The printer is provided with a carriage including a valve unit (liquid supplying device) having a liquid supply passage for supplying ink from an ink cartridge to a recording head. In the valve unit, a pressure chamber (liquid storage unit) for temporarily storing ink is defined in the liquid supply passage. The pressure chamber is formed by a flow passage formation body, which has a fixed shape, and a flexible film. Further, the pressure chamber includes an entrance, which is in communication with the upstream side of the liquid supply passage extending from the ink cartridge, and an exit, which is in communication with the downstream side of the liquid supply passage extending from the recording head.

An open/close valve that opens and closes to regulate the flow of ink from the entrance to the pressure chamber is arranged in the liquid supply passage. The film is displaced when sensing negative pressure generated as the ink in the pressure chamber decreases due to ink ejection from the recording head. The displacement of the film opens and closes the open/close valve to adjust the supply pressure of the ink supplied from the ink cartridge to the recording head.

To enable multi-color printing, recent printers include a plurality of ink cartridges containing different colors of ink. Further, a plurality of nozzle rows respectively corresponding to the ink cartridges are formed in the nozzle formation surface of the recording head. A plurality of liquid supply passages are formed between the ink cartridges and the corresponding nozzle rows. The liquid supply passages enable ink to be supplied from the ink cartridges to the corresponding nozzle rows. A pressure chamber is arranged in each liquid supply passage. The displacement of a film opens and closes an open/close valve to regulate the inward flow of the ink. The pressure chamber, which is formed by a flow passage formation body and a film, is arranged in each liquid supply passage. The printer disclosed in JP-A-2005-95861 has a similar structure, and the printer includes two valve units, each having two liquid supply passages with a pressure chamber arranged in each liquid supply passage.

However, in the structure in which a liquid supply passage and a pressure chamber are formed in each of the plurality of valve units, the flow passage formation body and the film that forming the pressure chamber differs between each valve unit. Thus, the liquid supply passages and the pressure chambers arranged in different valve units may differ between one another in the behavior of the negative pressure generated in the pressure chamber, the open/close timing of the open/close valve that corresponds to the displacement of the film based on the negative pressure, and the supply of the ink through the liquid supply passages. Accordingly, the ejection state of the ink ejected from the recording head varies between the nozzle rows, and satisfactory printing cannot be performed.

SUMMARY OF THE INVENTION

It is an object of the present invention to provide a liquid supplying device that supplies liquid with liquid supply passages in a uniform manner when liquid is supplied through the liquid supply passages from a plurality of liquid containers to a plurality of nozzle rows in a liquid ejection head.

To achieve the above object, one aspect of the present invention provides a liquid supplying device for supplying liquid that is supplied from a plurality of liquid containers to a liquid ejection head including a plurality of nozzle rows respectively corresponding to the plurality of liquid containers. The liquid supplying device includes a plurality of liquid supply passages and at least one flow passage formation body. Each of the liquid supply passages is capable of supplying liquid supplied from a corresponding one of the liquid containers to a corresponding one of the nozzle rows. Each of the liquid supply passages includes a common portion that is functionally in common with another one of the liquid supply passages. The common portions of the plurality of liquid supply passages are formed in the same flow passage formation body.

A further aspect of the present invention provides a liquid ejection apparatus including a plurality of liquid containers, a liquid ejection head, a plurality of liquid supply passages, and at least one flow passage formation body. The liquid ejection head includes a plurality of nozzle rows respectively corresponding to the plurality of liquid containers. Each of the liquid supply passages is capable of supplying liquid supplied from a corresponding one of the liquid containers to a corresponding one of the nozzle row. Each of the liquid supply passages includes a common portion that is functionally in common with another one of the liquid supply passages. The common portions of the plurality of liquid supply passages are formed in the same flow passage formation body.

BRIEF DESCRIPTION OF THE DRAWINGS

The invention, together with objects and advantages thereof, may best be understood by reference to the following description of the presently preferred embodiments together with the accompanying drawings in which.

DESCRIPTION OF EXEMPLARY EMBODIMENTS

One embodiment embodying the present invention will now be described according to FIGS. 1 to 22.

Figure 1:
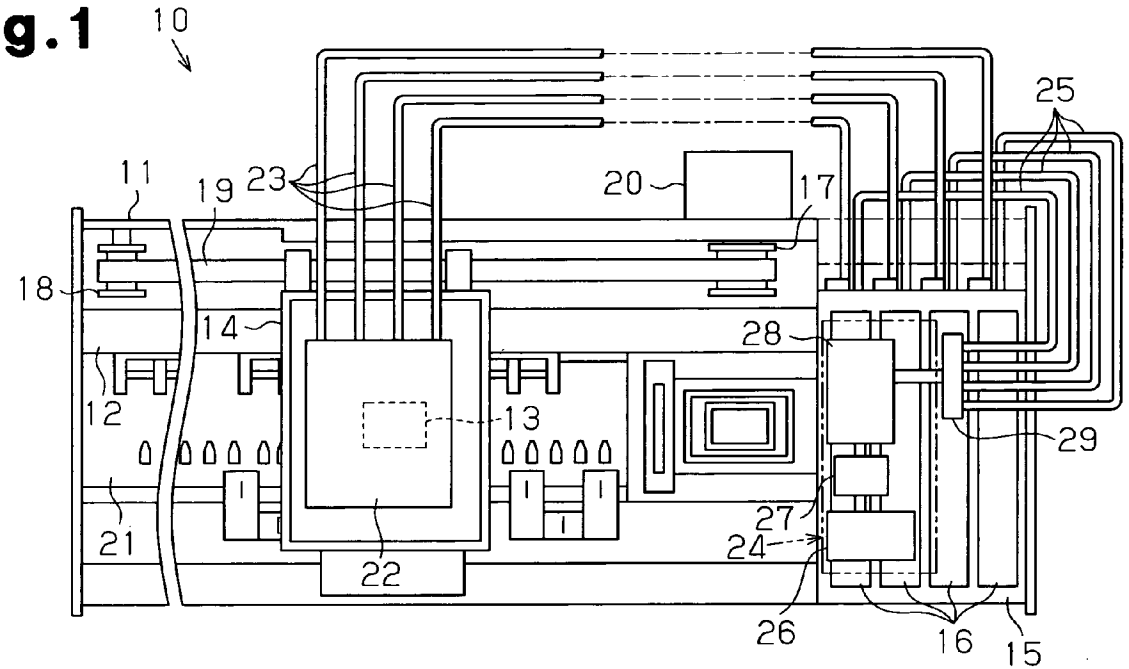
FIG. 1 is a schematic plan view showing an ink jet printer of the present embodiment.

As shown in FIG. 1, an ink jet printer (hereinafter referred to as a "printer") 10, which serves as a liquid ejection apparatus of the present embodiment, includes a main body case 11 having a rectangular shape when seen from above. A rod-shaped guide shaft 12 is arranged in the main body case 11, and the guide shaft 12 extends in the longitudinal direction (lateral direction in FIG. 1) of the main body case 11. The guide shaft 12 supports a carriage 14, on which a recording head 13 serving as a liquid ejection head is mounted. The carriage 14 reciprocates in the longitudinal direction of the guide shaft 12.

A cartridge holder 15 is arranged in the main body case 11 at a position (right end side position in FIG. 1) outside the movement range of the carriage 14. A plurality of (four in the present embodiment) ink cartridges 16 serving as liquid containers are detachably attached to the cartridge holder 15. That is, the printer 10 of the present embodiment is not a so-called on-carriage type printer, in which the ink cartridge is mounted on the carriage to move together with the carriage, but is a so-called off-carriage type printer, in which the ink cartridge 16 is fixed at a location separated from the carriage 14 and does not move together with the carriage 14. The number of ink cartridges 16 corresponds to the number of ink colors (e.g., the colors of black, yellow, magenta, cyan) used in the printer 10.

A drive pulley 17 and a driven pulley 18 are rotatably supported on the main body case 11. The drive pulley 17 and the driven pulley 18 are located at positions corresponding to the two ends of the guide shaft 12 on the inner surface of the rear wall of the main body case 11. An endless timing belt 19 connects the drive pulley 17 and the driven pulley 18. A carriage motor 20 fixed to the rear wall of the main body case 11 has an output shaft (not shown) coupled to the drive pulley 17. The drive force of the carriage motor 20 transmitted by the timing belt 19 reciprocates the carriage 14 in the direction of the guide shaft 12 (lateral direction of FIG. 1), that is, the main scanning direction.

A platen 21 arranged below the guide shaft 12 in the main body case 11 extends in the lateral direction. The platen 21 is a support base for supporting paper (not shown), which serves as a target, and feeds the paper towards the front side (lower side in FIG. 1) of the printer 10 as a paper feeding motor (not shown) produces rotation.

A valve unit 22, which serves as a liquid supplying device is mounted on the carriage 14, supplies the ink (liquid) supplied from each ink cartridge 16 to the recording head 13. A plurality (four in the present embodiment) ink supply tubes 23 is connected to the valve unit 22. Each ink supply tube 23 is connected to a corresponding one of the ink cartridges 16. This enables ink to be supplied from each ink cartridge 16 to the valve unit 22. The valve unit 22 temporarily stores ink drawn from each ink cartridge 16 via the corresponding ink supply tube 23, adjusts the stored ink to a predetermined pressure, and supplies the ink to the corresponding nozzle row 13A (see FIG. 20) of the recording head 13. Each ink supply tube 23 forms part of a liquid supply passage for supplying ink from the corresponding ink cartridge 16 to the recording head 13.

A pressurizing unit 24 is arranged above the cartridge holder 15 in the main body case 11. The pressurizing unit 24, which includes a pressurizing pump 26, a pressure sensor 27, and an atmospheric valve 28, sends the pressurized air (pressurized gas) to the ink cartridges 16 through an air supply tube 25. The air supply tube 25 is branched into a plurality (four in the present embodiment) of tubes from a distributor 29 arranged downstream from the atmospheric valve 28. Each branched tube is connected to a corresponding one of the ink cartridges 16.

Figure 2:
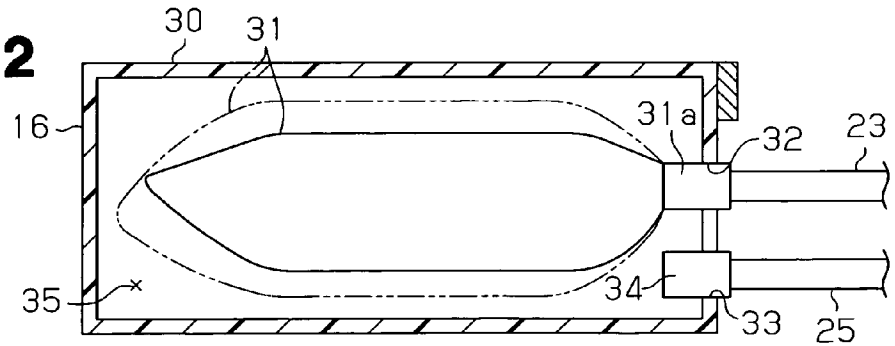
FIG. 2 is a cross-sectional view showing the structure of an ink cartridge of FIG. 1.

As shown in FIGS. 1 and 2, each ink cartridge 16 has a box-shaped ink case 30. An ink pack 31 containing ink is accommodated in the ink case 30. An ink supply connection port 32 extending through one side wall (right wall as viewed in FIG. 2) of the ink case 30 is located at a generally middle position of the side wall with respect to the vertical direction. A tubular ink discharge port 31*a* formed integrally with the ink pack 31 has a distal end fitted into the ink supply connection port 32 and exposed from the ink case 30. An ink supply tube 23 is connected to the ink discharge port 31*a*.

An air supply connection port 33 extends through one side wall of the ink case 30. The air supply connection port 33 is located below the ink supply connection port 32. A tubular connection tube 34 is fitted into the air supply connection port 33. The connection tube 34 has a first end (right end in FIG. 2) exposed from the ink case 30 and a second end located in the ink case 30. The distal end of an air supply tube 25 extending from the pressurizing pump 26 as described above is connected to the first end of the connection tube 34 that is exposed from the ink case 30. A hermetic air chamber 35 is formed between the inner surface of the ink case 30 and the outer surface of the ink pack 31.

When the pressurizing pump 26 is driven to feed pressurized air into the air chamber 35 of the ink case 30 through the air supply tube 25, the ink pack 31 is squeezed by the air pressure (pressurized force) of the pressurized air. The squeezed ink pack 31 supplies the ink in the ink pack 31 to the valve unit 22 via the ink supply tube 23.

The valve unit 22 will now be described.

Figure 3:
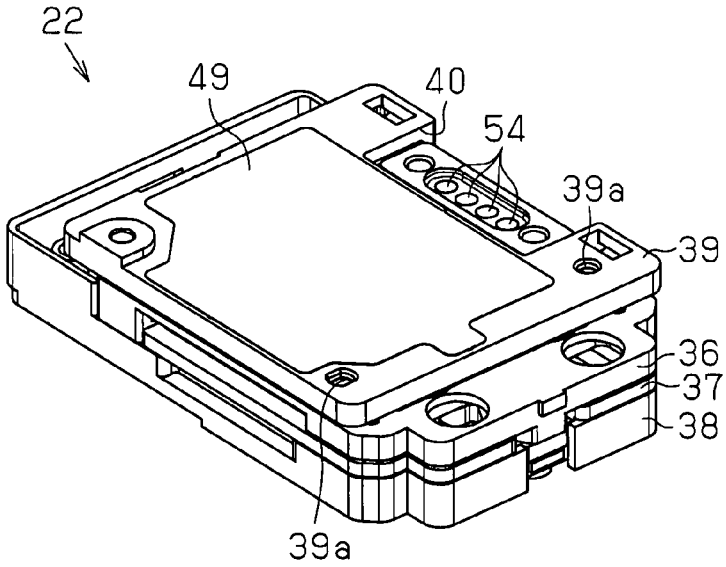
FIG. 3 is a perspective view showing a valve unit of FIG. 1.

As shown in FIG. 3, the valve unit 22 includes a pressure chamber component 36, a first flow passage component 37, a second flow passage component 38, and a generally flat protection plate 39. The pressure chamber component 36, the first flow passage component 37, and the second flow passage component 38 are thin plates and form a flow passage formation body having a fixed shape. The valve unit 22 is a single unit formed by stacking from the bottom the second flow passage component 38, the first flow passage component 37, the pressure chamber component 36, and the protection plate 39. The detailed structure of the protection plate 39, the pressure chamber component 36, the first flow passage component 37, and the second flow passage component 38 will be described below. With regard to each of the above components, the surface located on the upper side as viewed in FIG. 3 in the stacked state is referred to as the front surface and the surface located on the lower side is referred to as the rear surface.

The detailed structure of the protection plate 39 will first be described.

Figure 4:
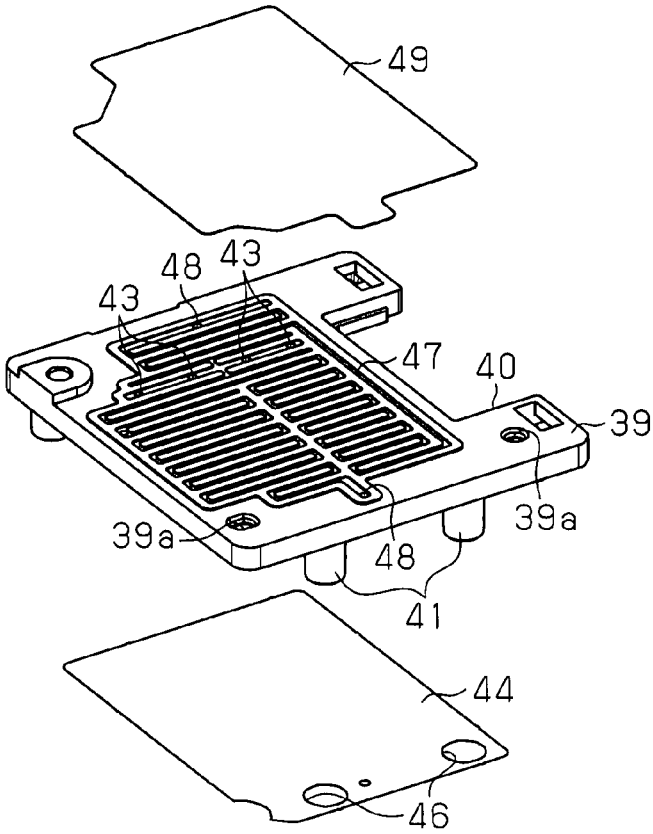
FIG. 4 is an exploded perspective view showing a protection plate from a diagonally upward direction.
Figure 5:
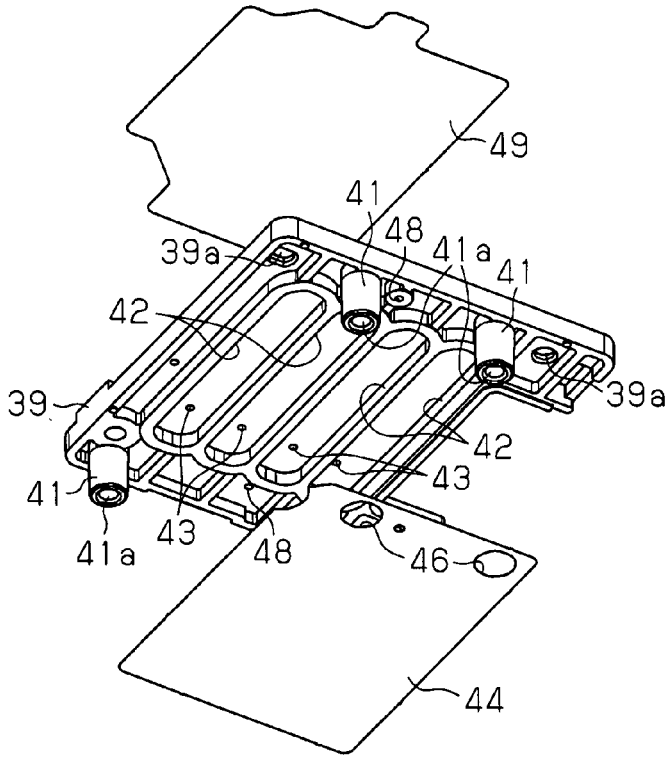
FIG. 5 is an exploded perspective view showing the protection plate from a diagonally downward direction.
Figure 6:
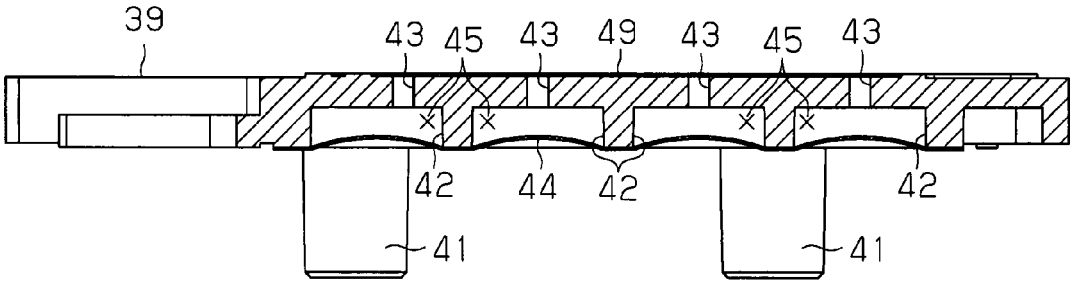
FIG. 6 is a cross-sectional view of the protection plate.

As shown in FIGS. 4 to 6, the protection plate 39 is a resin plate and has a rectangular cutaway portion 40 formed in the vicinity of one of the two long sides. Four cylindrical bushings 41 are arranged on the rear surface of the protection plate 39. A threaded hole 41*a* is formed in the distal end surface of each cylindrical bushing 41. As shown in FIGS. 5 and 6, a plurality of (four in the present embodiment) identical conduit recesses 42 are formed in the rear surface of the protection plate 39. The conduit recesses 42 extend parallel to one another in the longitudinal direction of the protection plate 39. A through hole 43 having a small diameter is formed in the bottom surface of each conduit recess 42. The through hole 43 is located near one end of each conduit recess 42.

A seal film 44 serving as a film member is thermally welded and attached to the rear surface of the protection plate 39 so as to cover the plurality of conduit recesses 42. The seal film 44 is a flexible thin film. The seal film 44 is subjected to pressure molding in advance so that the regions corresponding to the conduit recesses 42 are dome-shaped and slightly curved into the conduit recesses 42, as shown in FIG. 6. An air chamber 45 is formed between the seal film 44 and each conduit recess 42. Positioning holes 46 corresponding to two of the four cylindrical bushings 41 of the protection plate 39 are formed in the seal film 44. The positioning holes 46 function as a positioning portion for guiding the corresponding cylindrical bushings 41 when attaching the seal film 44 to the rear surface of the protection plate 39 so that the curved regions of the seal film 44 are arranged at appropriate positions corresponding to the conduit recesses 42.

As shown in FIG. 4, a series of groove portions 47, which are in communication with the through holes 43, are extend in a meandering manner in the front surface of the protection plate 39. Atmospheric communication holes 48 having a small diameter extend through the groove portions 47 at positions separated from the conduit recess 42 in the rear surface of the protection plate 39. A barrier film 49 having high gas barrier properties is thermally welded and attached to the front surface of the protection plate 39 so as to cover the through holes 43, the series of groove portions 47, and the atmospheric communication holes 48. The barrier film 49 may be a film made of polyethylene, polypropylene, polyester, polyamide, or the like on which aluminum, silica, or the like is deposited.

Pilot holes 39*a* functioning as the positioning portions extend through the protection plate 39 in the vicinity of the two corners on one of the two short sides (the closer short side as viewed in FIGS. 3 and 4) of. Among the two pilot holes 39*a*, the main pilot hole 39*a* located near the cutaway portion 40 is round and the other sub-pilot hole 39*a* is oval.

The detailed structure of the pressure chamber component 36 will now be described.

Figure 7:
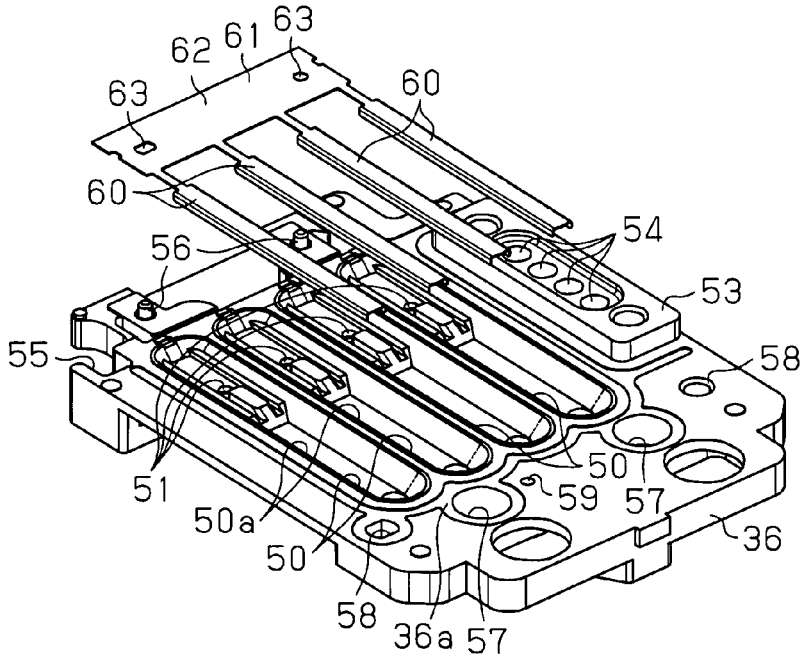
FIG. 7 is an exploded perspective view showing a pressure chamber component.
Figure 8:
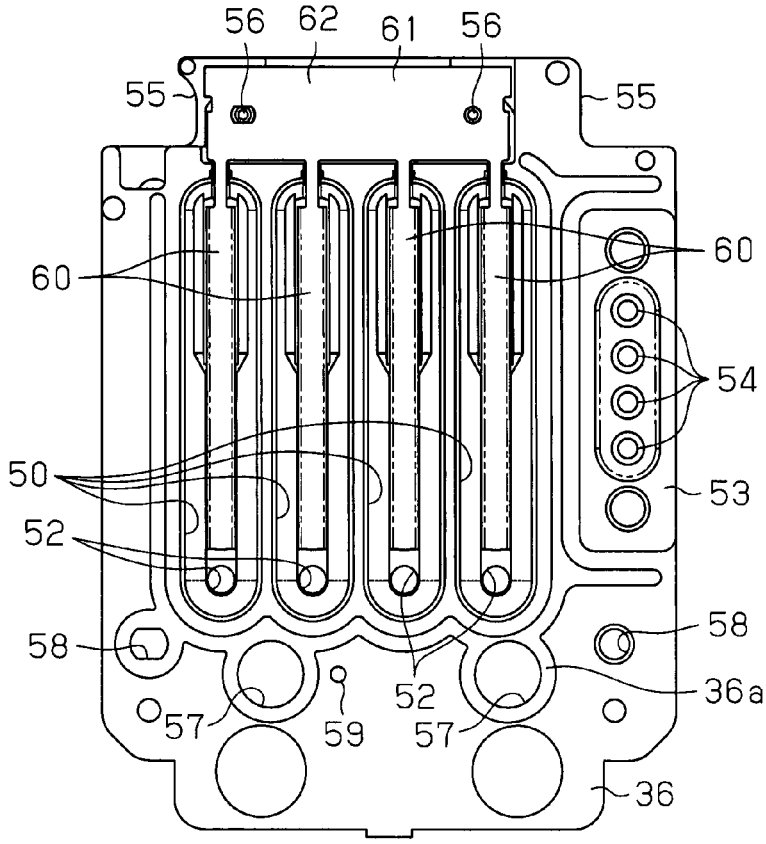
FIG. 8 is a plan view showing the pressure chamber component.
Figure 9:
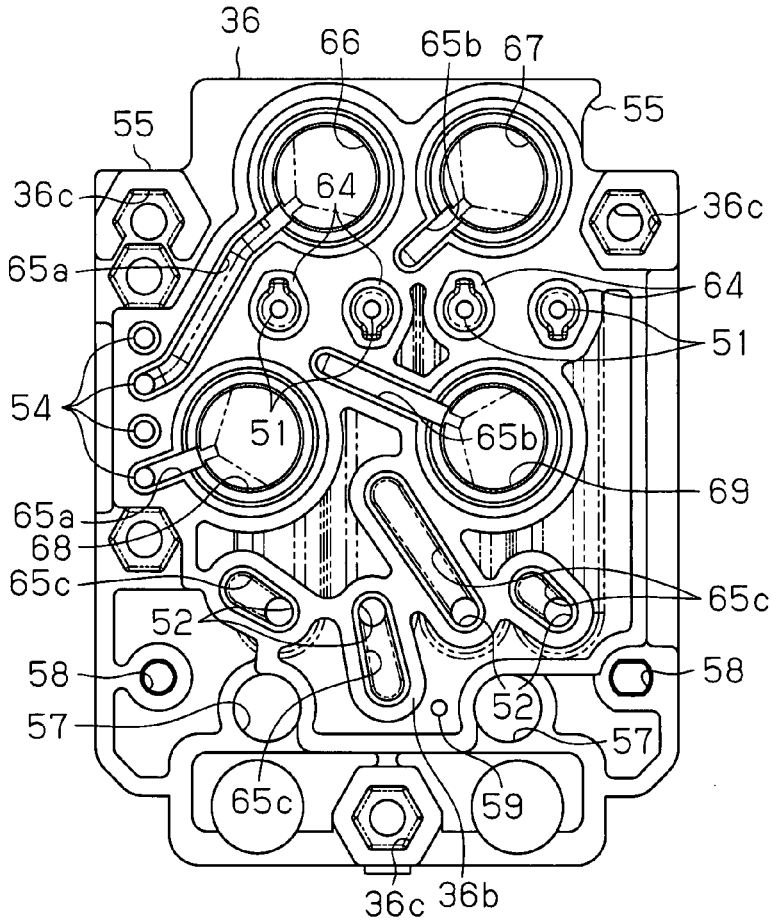
FIG. 9 is a bottom plan view showing the pressure chamber component.

As shown in FIGS. 7 to 9, the pressure chamber component 36 is a rectangular resin plate and has a plurality of (four in the present embodiment) of identical conduit flow passages (part of liquid supply passage) 50 formed in the front surface so as to respectively correspond to the plurality of conduit recesses 42 in the protection plate 39. The plurality of conduit flow passages 50 are identical and extend parallel to one another in the longitudinal direction of the pressure chamber component 36. When the protection plate 39 is joined with the pressure chamber component 36, openings 50*a* of the conduit flow passages 50 are sealed by the seal film 44 on the rear surface of the protection plate 39. Each conduit flow passage 50 defines a pressure chamber 50A (see FIG. 22) sealed by the seal film 44.

An entrance 51 having a small diameter extends through the inner bottom surface of each conduit flow passage 50 near a first end, and an exit 52 having a small diameter extends through the inner bottom surface of each conduit flow passage 50 near a second end. A rectangular seat 53 projects from the front surface of the pressure chamber component 36 in the vicinity of one of the two long sides. The seat 53 is fitted to the cutaway portion 40 of the protection plate 39 for positioning when joining the pressure chamber component 36 and the protection plate 39. A plurality of (four in the present embodiment) of liquid inlets 54 extend through the seat 53. The downstream end of an ink supply tube 23 is connected to each liquid inlet 54.

Cutaway portions 55, which engage two of the four cylindrical bushings 41 on the protection plate 39 when the pressure chamber component 36 and the protection plate 39 are joined, are formed at the two corners at a first end side in the longitudinal direction of the pressure chamber component 36. Two positioning pins 56 spaced by a fixed distant in the lateral direction of the pressure chamber component 36 are arranged near the first longitudinal end of the pressure chamber component 36 on the front surface of the pressure chamber component 36. The positioning pins 56 project upward.

Two insertion holes 57 enabling the insertion of the two remaining cylindrical bushings 41 on the protection plate 39 extend through the pressure chamber component 36 near the second longitudinal end. The insertion holes 57 serve as the positioning portions. A pilot hole 58 (positioning portion) aligned with the pilot hole 39*a* of the protection plate 39 when the pressure chamber component 36 and the protection plate 39 are joined extends through the vicinity of each insertion hole 57.

Furthermore, an atmospheric communication hole 59 extends through the front surface of the pressure chamber component 36 in the vicinity of the insertion hole 57, as shown in FIGS. 7 and 8. The atmospheric communication hole 59 is aligned with one of the two atmospheric communication holes 48 of the protection plate 39 when the pressure chamber component 36 and the protection plate 39 are joined.

Moreover, an adhesive application portion 36*a* is arranged on the front surface of the pressure chamber component 36 around each conduit flow passage 50, each insertion hole 57, and each pilot hole 58, as shown in FIG. 7. The adhesive application portion 36*a* is the region in which an adhesive is applied to join the pressure chamber component 36 and the protection plate 39. When adhesive is applied to this region and the pressure chamber component 36 and protection plate 39 are joined with each other, the portion of the seal film 44 corresponding to the adhesive application portion 36*a* is the adhered region.

As shown in FIGS. 7 and 8, an elastic plate (elastic member) 62 is attached to the front surface of the pressure chamber component 36. The elastic plate 62 includes a base portion 61 and a plurality of (four in the present embodiment) elastic strips 60 extending from the base portion 61 in a comb-like manner to form actuating levers. Each elastic strip 60 corresponds to one of the conduit flow passage 50. Two press-fitting holes 63 are formed in the base portion 61 of the elastic plate 62. The two positioning pins 56 of the pressure chamber component 36 are inserted into and press-fitted to the two press-fitting holes 63. This connects the elastic plate 62 to the pressure chamber component 36 so that each elastic strip (actuating lever) is cantilevered in the corresponding conduit flow passage 50.

A plurality of (four in the present embodiment) valve receptacles 64 are formed in the rear surface of the pressure chamber component 36. Each valve receptacle 64 corresponds to one of the entrances 51 and is aligned coaxially with the corresponding entrance 51, as shown in FIG. 9. Further, in the rear surface of the pressure chamber component 36, two conical recesses 66 and 67 are formed between one longitudinal end of the pressure chamber component 36 and the four valve receptacles 64 (each entrance 51), and two conical recesses 68 and 69 are formed between the four valve receptacles 64 and the four exits 52. The recesses 66 to 69 are identically shaped.

As shown in FIG. 9, ink flow passages (part of liquid supply passage) 65*a* for respectively connecting two of the recesses 66 to 69 that are located near the liquid inlet 54, namely, the recesses 66 and 68, to the liquid inlets 54 that are second and fourth from the top as viewed in FIG. 9 are formed on the rear surface of the pressure chamber component 36 so as to directly draw ink into the recesses 66 and 68 from the liquid inlets 54. Ink flow passages (part of liquid supply passage) 65*b* extend in the rear surface of the pressure chamber component 36 from the two remaining recesses 67 and 69 to predetermined positions. At locations in the rear surface of the pressure chamber component 36 corresponding to the exits 52, ink flow passages (part of liquid supply passage) 65*c* are formed to guide ink that flows out of the conduit flow passages 50 through the exits 52 from the front surface to the rear surface in the front surface towards four spaced positions located in four different directions.

An adhered region 36*b* is defined on the rear surface of the pressure chamber component 36 around the liquid inlets 54, the valve receptacles 64, the ink flow passages 65*a*, 65*b*, and the recesses 66 to 69. Adhesive applied to the first flow passage component 37 adheres to the adhered region 36*b* when joining the pressure chamber component 36 and the first flow passage component 37.

As shown in FIG. 9, a nut receptacle 36*c* for receiving a hexagon nut (not shown) is formed in the vicinity of each cutaway portion 55 of the pressure chamber component 36 outside the adhered region 36*b*. Furthermore, a nut receptacle 36*c* for receiving a hexagon nut (not shown) is formed in the vicinity of the second end of the pressure chamber component 36 outside the adhered region 36*b*.

The detailed structure of the first flow passage component 37 will now be described.

Figure 10:
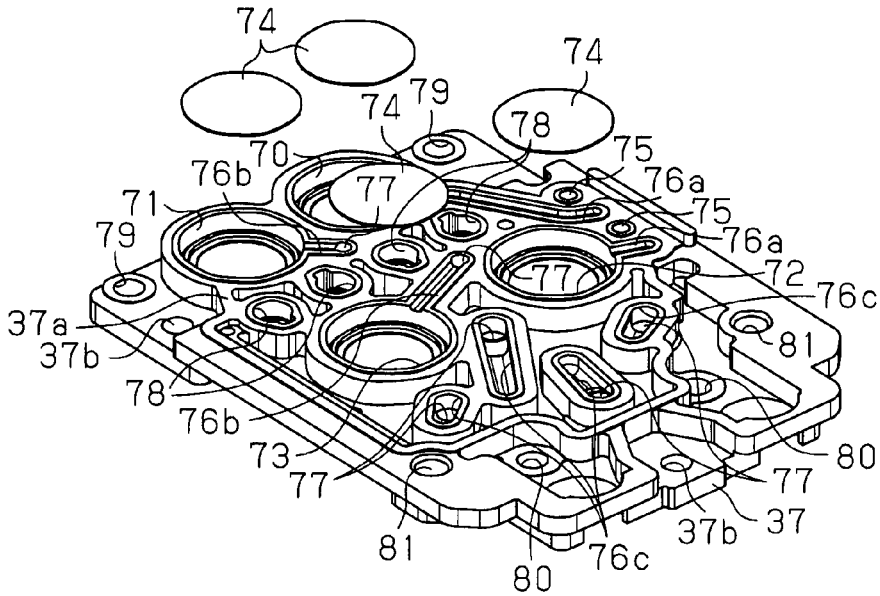
FIG. 10 is a perspective view showing a first flow passage component.

As shown in FIG. 10, the first flow passage component 37 is a resin rectangular plate and having an outer contour substantially identical to the pressure chamber component 36 when viewed in the stacking direction. More specifically, the outer contour of the first flow passage component 37 differs from that of the pressure chamber component 36 only in that the cutaway portions 55 formed in the pressure chamber component 36 whereas the first flow passage component 37 does not have such cutaway portions.

As shown in FIG. 10, flow passages, recesses, and holes are formed in the front surface of the first flow passage component 37 in mirror relationship with the rear surface of the pressure chamber component 36. Specifically, a plurality of (four in the present embodiment) recesses 70 to 73 corresponding to the plurality of recesses 66 to 69 of the pressure chamber component 36 are formed in the front surface of the first flow passage component 37. When the pressure chamber component 36 and the first flow passage component 37 are joined, the recess 66 is aligned with the recess 70, the recess 67 is aligned with the recess 71, the recess 68 is aligned with the recess 72, and the recess 69 is aligned with the recess 73.

A round inlet filter member 74 made of a metal mesh is thermally welded and attached to a large diameter portion of each of the recesses 70 to 73 in the first flow passage component 37. The inlet filter member 74 filters the ink that flows into the valve unit 22 from the liquid inlets 54 to capture foreign matter in the ink. In the present embodiment, the mesh roughness of the inlet filter member 74 is set to about 29 microns to capture foreign matter that is larger than 30 microns.

As shown in FIG. 10, ink passages 75 extend through the front surface of the first flow passage component 37. The ink passages 75 are aligned with the first and third liquid inlets 54 from the top of the pressure chamber component 36 as viewed in FIG. 9. Ink flow passages (part of liquid supply passage) 76*a* respectively extend towards the two recesses 70 and 72 from locations corresponding to the remaining second and fourth liquid inlets 54. Each ink flow passage 76*a* is formed in mirror relationship with the corresponding ink flow passage 65*a* formed in the rear surface of the pressure chamber component 36.

Ink flow passages (part of liquid supply passage) 76*b* shaped identically to the ink flow passage 65*b* are formed in the front surface of the first flow passage component 37 at locations corresponding to the ink flow passages 65*b* of the pressure chamber component 36 and extend from the recesses 71 and 73 to predetermined positions. A through hole 77 is formed in the inner bottom surface of the distal end of each ink flow passage 76*b*. The through holes 77 are connected to the ink passages 75 described above through ink flow passages (not shown) formed in the rear surface of the first flow passage component 37. The ink supplied from the liquid inlets 54 located at the upstream side is guided to the recess 67 and 69 flowing through the ink passages 75, the ink flow passages in the rear surface (not shown), the through holes 77, and then the ink flow passages 76*b* in the front surface.

A plurality of (four in the present embodiment) valve receptacles 78 extends through the first flow passage component 37 at location corresponding to the plurality of valve receptacles 64 of the pressure chamber component 36. Each valve receptacle 78 has a mirror relationship with the corresponding valve receptacle 64. Ink is guided to the valve receptacles 78 from the recesses 70 to 73 located at the upstream side through holes (not shown) extending through the inner bottom surface of the recesses 70 to 73 and ink flow passage (not shown) formed continuously from the passage holes in the rear surface of the first flow passage component 37*e*.

Threaded insertion hole 79 is formed in the front surface of the first flow passage component 37 at locations corresponding to the cutaway portions 55 of the pressure chamber component 36. Each threaded insertion hole 79 is aligned with the distal end surface (i.e., threaded hole 41*a*) of the corresponding one of the cylindrical bushings 41 on the protection plate 39 when the pressure chamber component 36 and the protection plate 39 are stacked on the first flow passage component 37. Two insertion holes 80 and two pilot holes (positioning portions) 81 extend through the front surface of the first flow passage component 37. Each of the insertion holes 80 and pilot holes 81 is aligned with the corresponding ones of the insertion holes 57 and the pilot holes 58 of the pressure chamber component 36.

As shown in FIG. 10, an adhesive application portion 37*a* corresponding to the adhered region 36*b* of the pressure chamber component 36 described above is formed on the front surface of the first flow passage component 37 around the recesses 70 to 73, the ink passage 75, the ink flow passages 76*a* to 76*c*, and the valve receptacles 78. Furthermore, a plurality of (only two are shown in FIG. 10) threaded insertion holes 37*b* are formed outside the adhesive application portion 37*a*. Each threaded insertion hole 37*b* is aligned with the corresponding nut receptacle 36*c* of the pressure chamber component 36.

The detailed structure of the second flow passage component 38 will now be described.

Figure 11:
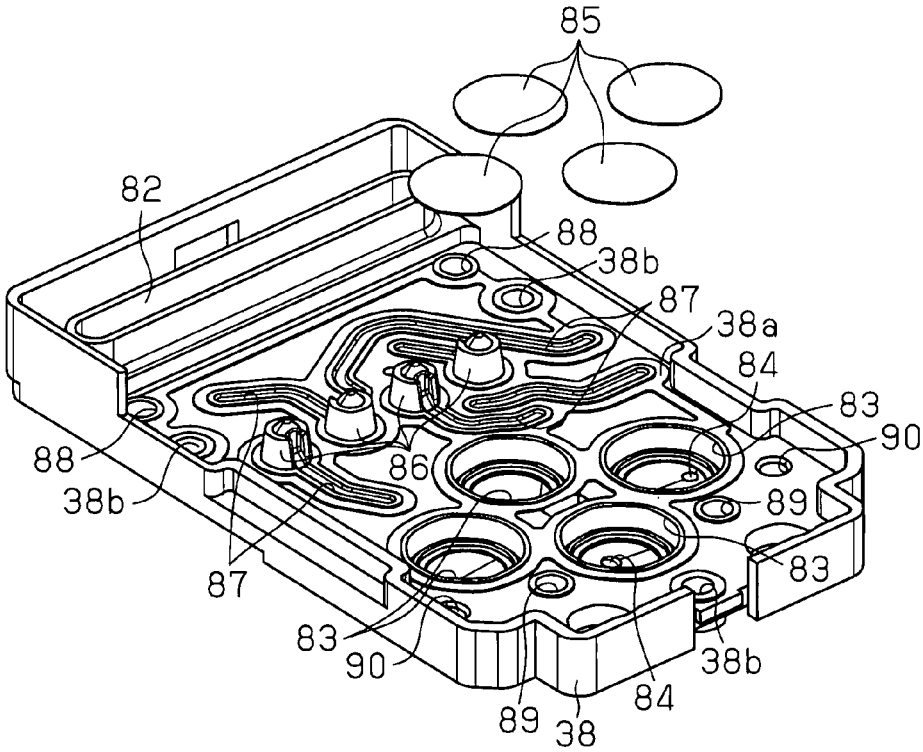
FIG. 11 is a perspective view showing a second flow passage component.

As shown in FIG. 11, the second flow passage component 38 is a resin plate having a rectangular shape in plan view and having an outline shape substantially the same as the first flow passage component 37 when seen in the stacking direction. That is, the second flow passage component 38 differs from the first flow passage component 37 in outline shape in that one end side region is formed longer than the first flow passage component 37, and a terminal insertion part 82 is formed at such one end side region.

FIG. 11 is a perspective view showing the second flow passage component 38. As shown in the drawing, flow passages, recesses, and holes are formed in the front surface of the second flow passage component 38 in mirror relationship with the rear surface of the first flow passage component 37. Specifically, a plurality of (four in the present embodiment) recesses 83 corresponding to recesses (not shown, recesses extending about the through holes 77) formed in the rear surface of the first flow passage component 37 are formed in the front surface of the second flow passage component 38. A liquid outlet 84 extends through the inner bottom surface of each recess 83. The liquid outlet 84 becomes the outlet for ink exiting the valve unit 22.

A round outlet filter member 85 made of a metal mesh is thermally welded and attached to the large diameter portion of each recess 83 of the second flow passage component 83. The outlet filter members 85 filter the ink flowing out of the valve unit 22 through the liquid outlets 84 and captures foreign matter in the ink. In the present embodiment, the mesh roughness of the outlet filter member 85 is set to about 19 microns to capture foreign matter smaller than 20 microns, which is equivalent to the diameter of a nozzle 13*a* (see FIG. 22) of the recording head 13. That is, the outlet filter members 85 capture further finer matter than the inlet filter members 74.

As shown in FIG. 11, a plurality of (four in the present embodiment) tubular seats 86 insertable into the valve receptacles 78 project from the front surface of the second flow passage component 38 at locations corresponding to the four valve receptacles 78 of the first flow passage component 37. Each tubular seat 86 is a cylindrical body in which the distal end side has a smaller diameter than the basal end side and in which the cross-section is substantially C-shaped by cutting away part of the side wall of the cylindrical body in the vertical direction. A plurality of ink flow passages (one part of liquid supply passage) 87 are formed in the front surface of the second flow passage component 38. Each ink flow passage 87 is in communication with the inner side of the corresponding tubular seat 86 through the cutaway portion. The ink flow passages 87 extend to communicate the tubular seats 86 to through holes (not shown) formed in the inner bottom surface of the recesses 70 to 73 of the first flow passage component 37 when the first flow passage component 37 is stacked on the second flow passage component 38.

Threaded insertion holes 88 are formed in the front surface of the second flow passage component 38 at locations corresponding to the two threaded insertion holes 79 of the first flow passage component 37. Insertion holes 89 and pilot holes (positioning portion) 90 extend through the front surface of the second flow passage component 38 at locations corresponding to the insertion holes 80 and the pilot holes 81 of the first flow passage component 37.

As shown in FIG. 11, an adhesive application portion 38*a* corresponding to the adhering region (not shown) defined on the rear surface of the first flow passage component 37 is formed on the front surface of the second flow passage component 38 around the recesses 83, the ink flow passages 87, and the threaded insertion holes 88. Threaded insertion holes 38*b* corresponding to the threaded insertion holes 37*b* of the first flow passage component 37 are formed outside the adhesive application portion 38*a* in the front surface of the second flow passage component 38.

Figure 12:
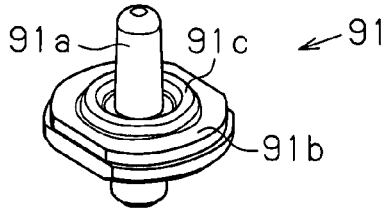
FIG. 12 is a perspective view showing a movable valve.
Figure 13:
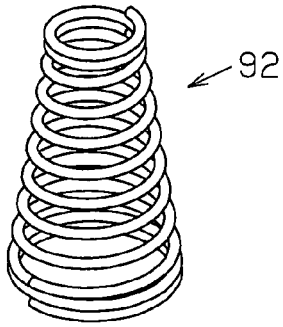
FIG. 13 is a perspective view showing a seal spring.

When the first flow passage component 37 and the pressure chamber component 36 are stacked on the second flow passage component 38, a movable valve (open/close valve) 91 shown in FIG. 12 is received in each valve receptacle 78 of the first flow passage component 37 and each valve receptacle 64 of the pressure chamber component 36. A seal spring 92 shown in FIG. 13 is attached to the tubular seat 86 of the second flow passage component 38.

The movable valve 91 includes a shaft portion 91*a*, which is insertable into an entrance 51 of the pressure chamber component 36, and a flange portion 91*b*, which is movable in the axial direction of the shaft portion 91*a* in the valve receptacle 64 of the pressure chamber component 36 and the valve receptacle 78 of the first flow passage component 37, as shown in FIG. 12. An annular seal portion 91*c* made of an elastomer or the like is formed on the surface of the flange portion 91*b* through two-color molding. As shown in FIG. 13, the seal spring 92 is a coil spring having a conical shape in correspondence with to the outer contour of the tubular seat 86. The shaft portion 91*a* of the movable valve 91 has a basal end inserted into a distal end portion of the seal spring 92 that has a small diameter.

A method for manufacturing the valve unit 22 by assembling the protection plate 39, the pressure chamber component 36, the first flow passage component 37, and the second flow passage component 38 will now be discussed with reference to FIGS. 14 to 19. In FIGS. 14 to 19, the reference characters associated with the detailed parts of each component (e.g., first flow passage component 37) are omitted to simplify the drawings.

As shown in FIGS. 14 to 19, when assembling the valve unit 22 in a stacked state, an assembly jig 100, screw members 101 serving as pressure contact members, and an adhesive (not shown) are used. The assembly jig 100 includes a planar base plate 100*a*. A plurality of (two in the present embodiment) positioning rods 100*b* project from the upper surface of the base plate 100*a* at a fixed interval. The interval between the positioning rods 100*b* corresponds to the interval between the pairs of pilot holes 39*a*, 58, 81, and 90 respectively formed on the protection plate 39, the pressure chamber component 36, the first flow passage component 37, and the second flow passage component 38.

Figure 14:
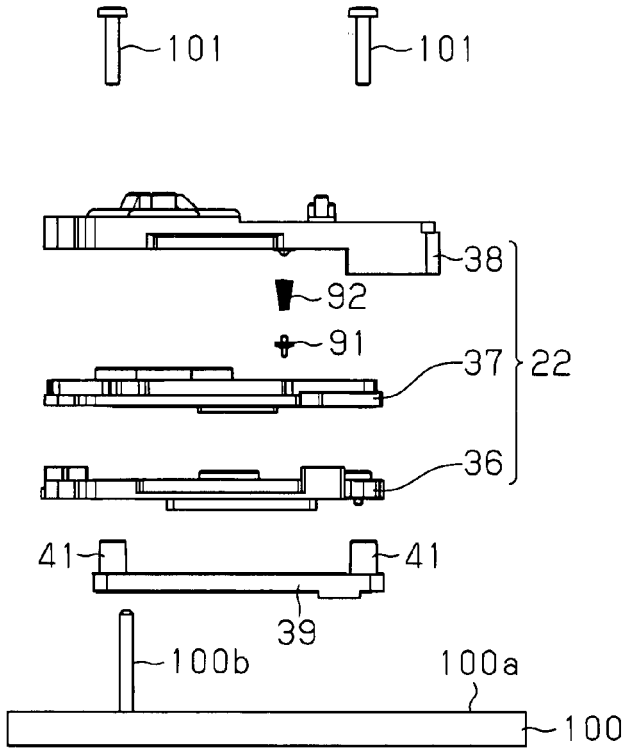
FIG. 14 is an exploded side view showing the procedures for assembling the valve unit.

When assembling the components together on the base plate 100*a* of the jig 100 in a stacked state, the protection plate 39 is arranged at the bottom. Then the pressure chamber component 36, the first flow passage component 37, and the second flow passage component 38 are stacked on top of each other, as shown in FIG. 14. The protection plate 39, the pressure chamber component 36, the first flow passage component 37, and the second flow passage component 38 are stacked upside down so that the front surfaces face downward and the rear surface face upward.

Figure 15:
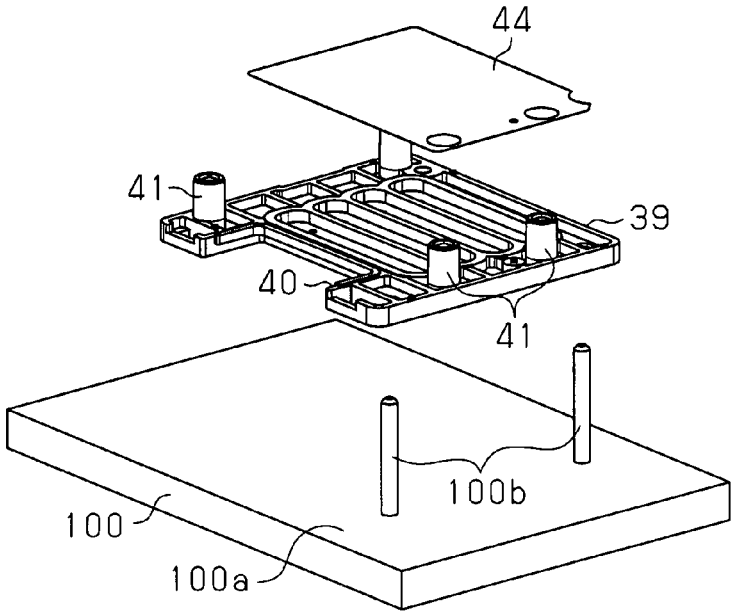
FIG. 15 is a perspective view showing the step of setting the protection plate.

First, the protection plate 39 is mounted on the base plate 100*a* of the jig 100 with the front surface facing downward, as shown in FIG. 15. In this state, the two positioning rods 100*b* formed on the base plate 100*a* are inserted into the pilot holes 39*a* of the protection plate 39. This positions the protection plate 39 on the base plate 100*a* with the cylindrical bushings 41 facing upward and movement in the horizontal direction being restricted. The barrier film 49 is thermally welded to the front surface of the protection plate 39 in advance.

The seal film 44 is then attached to the rear surface, which is facing upward, of the protection plate 39. Among the four cylindrical bushings 41 projecting from the rear surface of the protection plate 39, the two cylindrical bushings 41 spaced by a short interval are inserted into the positioning holes 46 of the seal film 44. This arranges the seal film 44 at a proper position so as to cover the conduit recesses 42 formed in the rear surface of the protection plate 39. The seal film 44 is thermally welded to the protection plate 39 with the regions of the seal film 44 that are dome-shape and curved through pressure molding being located in the conduit recesses 42. The seal film 44 may be attached to the rear surface of the protection plate 39 in advance.

Figure 16:
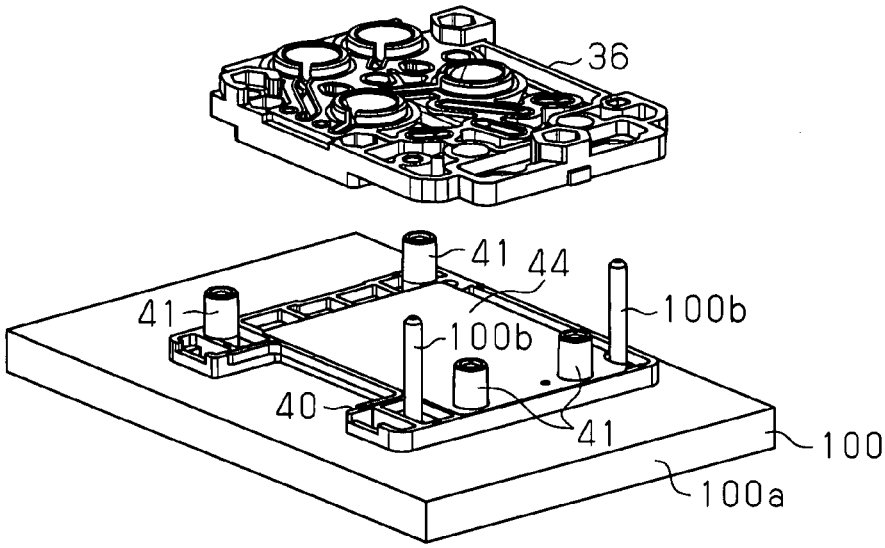
FIG. 16 is a perspective view showing the step of stacking the pressure chamber component.

Subsequently, the pressure chamber component 36 is arranged on the protection plate 39 with the front surface facing downward, as shown in FIG. 16. The elastic plate 62 is attached to the front surface of the pressure chamber component 36 in advance. Adhesive is applied to the adhesive application portion 36*a* of the front surface of the pressure chamber component 36. The pressure chamber component 36, to which adhesive is applied, is stacked on the rear surface of the protection plate 39. At the same time, the two positioning rods 100*b* of the jig 100 is inserted into the corresponding pilot holes 58 of the pressure chamber component 36.

As a result, the cylindrical bushings 41 of the protection plate 39 are inserted into the corresponding cutaway portions 55 and insertion holes 57 of the pressure chamber component 36, and the seat 53 of the pressure chamber component 36 is fitted into the cutaway portion 40 of the protection plate 39. The atmospheric communication hole 59 of the pressure chamber component 36 is in communication with the corresponding atmospheric communication hole 48 of the protection plate 39. In this state, the adhesive application portion 36*a* of the pressure chamber component 36 is arranged at the proper position at which the adhesive application portion 36*a* is aligned with the adhering region (region around the conduit recesses 42 (not shown)) of the seal film 44 attached to the protection plate 39.

Figure 17:
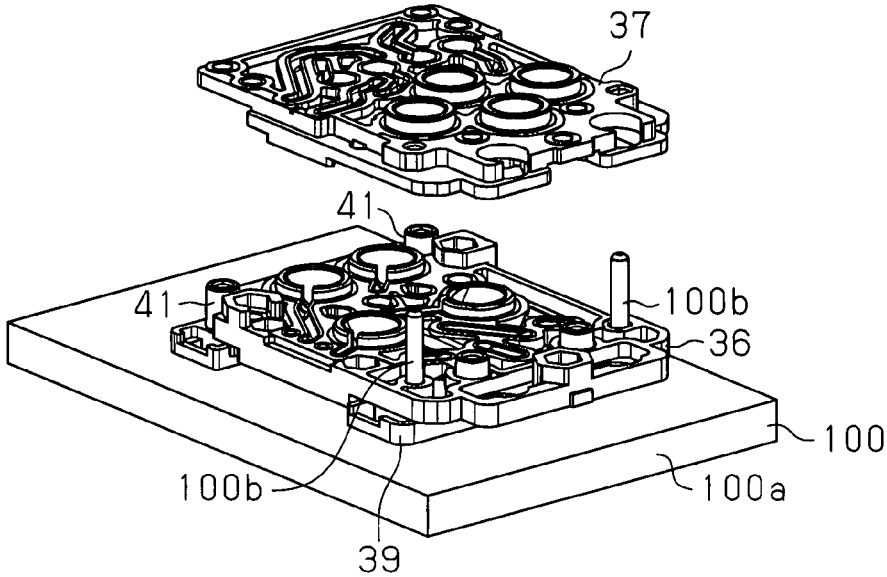
FIG. 17 is a perspective view showing the step of stacking the first flow passage component.

The first flow passage component 37 is then arranged on the pressure chamber component 36 with the front surface facing downward, as shown in FIG. 17. The inlet filter members 74 are attached in advance to the recesses 70 to 73 of the first flow passage component 37. Hexagonal nuts (not shown) are fitted in advance to the nut receptacles 36*c* of the rear surface, which is facing upward, of the pressure chamber component 36. Adhesive is applied to the adhesive application portion 37*a* of the front surface of the first flow passage component 37. The first flow passage component 37, to which adhesive is applied, is stacked on the rear surface of the pressure chamber component 36. At the same time, the two positioning rods 100*b* of the jig 100 is inserted into the corresponding pilot holes 81 of the first flow passage component 37.

The threaded insertion holes 79 and 80 of the first flow passage component 37 are aligned with the threaded holes 41*a* of the corresponding cylindrical bushings 41 of the protection plate 39, and the threaded insertion holes 37*b* are aligned with the corresponding nut receptacles 36*c* of the pressure chamber component 36. The recesses 70 to 73 and the ink flow passages 76*a* to 76*c* of the first flow passage component 37 are aligned with the corresponding recesses 66 to 69 and the ink flow passages 65*a* to 65*c* of the pressure chamber component 36, and the valve receptacles 78 of the first flow passage component 37 is aligned with the corresponding valve receptacles 64 of the pressure chamber component 36. In this state, the adhesive application portion 37*a* of the front surface of the first flow passage component 37 is arranged at a proper position in alignment with the adhered region 36*b* of the pressure chamber component 36.

Figure 18:
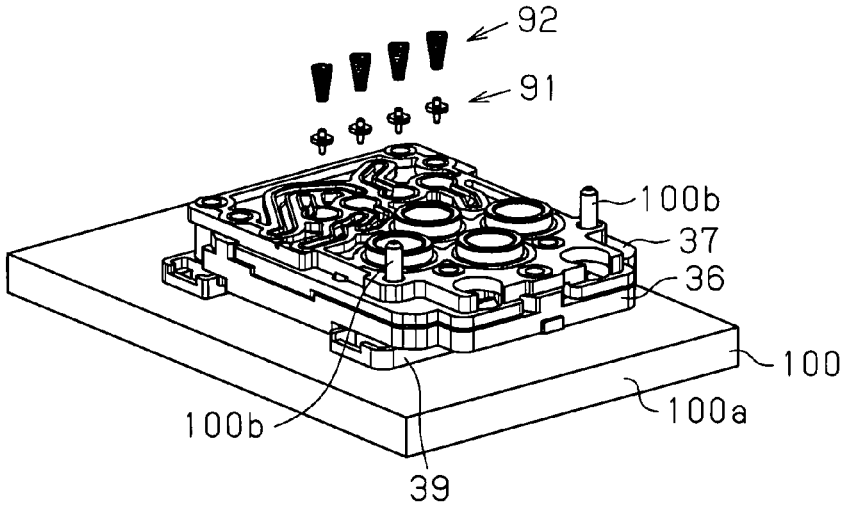
FIG. 18 is a perspective view showing the step of attaching movable valves and seal springs.

As shown in FIG. 18, the movable valves 91 and seal springs 92 are inserted to the corresponding valve receptacles 78 of the first flow passage component 37. Specifically, the shaft portion 91*a* of each movable valve 91 is first inserted to an entrance 51 of the pressure chamber component 36, and the flange portion 91*b* is inserted to the valve receptacle 64 of the pressure chamber component 36. Furthermore, the seal portion 91*c* is abut against the inner bottom surface of the valve receptacle 64 of the pressure chamber component 36. The seal spring 92 is then inserted into the valve receptacle 78 of the first flow passage component 37 such that the basal end of the shaft portion 91*a* of the movable valve 91 is inserted into the seal spring 92 at the distal end portion having a small diameter.

Figure 19:
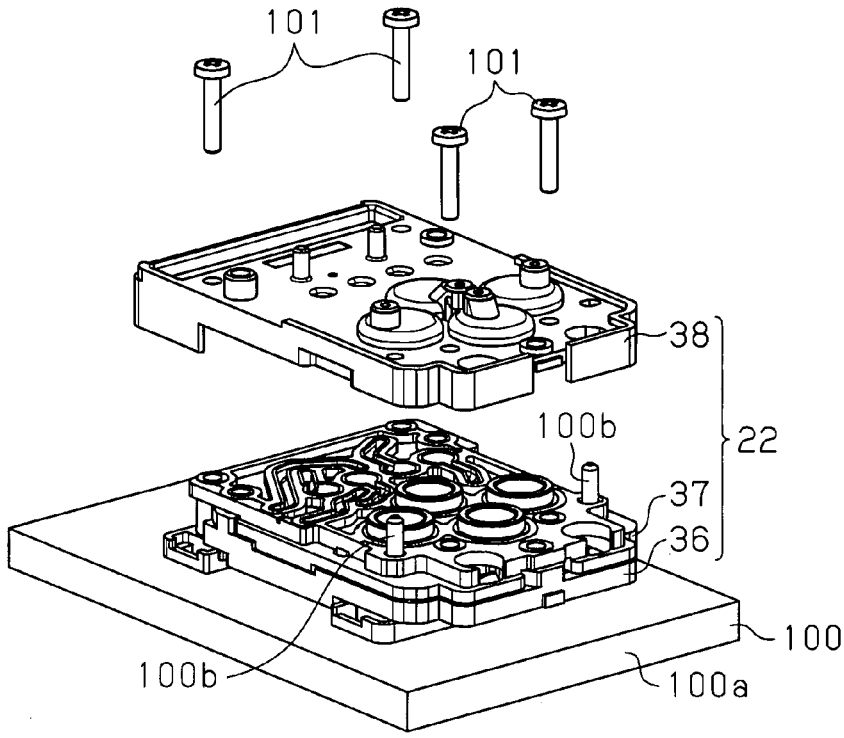
FIG. 19 is a perspective view showing the step of stacking the second flow passage component.

Thereafter, the second flow passage component 38 is arranged on the first flow passage component 37 with the front surface facing downward, as shown in FIG. 19. The outlet filter members 85 are attached in advance to the recesses 83 of the second flow passage component 38. The adhesive is applied to the adhesive application portion 38*a* of the front surface of the second flow passage component 38. The second flow passage component 38, to which adhesive is applied, is stacked on the rear surface of the first flow passage component 37. At the same time, the positioning rods 100*b* of the jig 100 are inserted to the corresponding pilot holes 90 of the second flow passage component 38.

The threaded insertion holes 88, 89, 38*b* of the second flow passage component 38 are thereby positioned with the corresponding threaded insertion holes 79, 80, 37*b* of the first flow passage component 37, and each recess 83 and each ink flow passage 87 are positioned with the corresponding concave part (not shown) and the ink flow passage (not shown) of the first flow passage component 37. Furthermore, the tubular seat 86 of the second flow passage component 38 is inserted to the corresponding valve receptacle 78 of the first flow passage component 37, and the distal end of the tubular seat 86 is inserted to the basal end portion having a large diameter of the seal spring 92 that is already inserted in the valve receptacle 78. In this state, the adhesive application portion 38*a* of the front surface of the second flow passage component 38 is arranged at an appropriate position at where the adhesive application portion 38*a* is positioned with the adhering region (not shown) formed on the rear surface of the first flow passage component 37.

A plurality of (four in the present embodiment) screw members 101 are inserted into the threaded insertion holes 88 and 89 of the second flow passage component 38, as shown in FIG. 19. The distal ends of the screw members 101 are extended through the corresponding threaded insertion holes 79 and 80 of the first flow passage component 37 and fastened to the threaded holes 41*a* of the corresponding cylindrical bushings 41 on the protection plate 39. The fastening force of the screw members 101 hold the flow passage formation bodies (the pressure chamber component 36, first flow passage component 37, and second flow passage component 38) with the protection plate 39 in a clamped state with adhesive applied between the flow passage formation bodies that are adjacent to each other in the stacking direction.

The adhesive between the adjacent flow passage formation bodies dry and harden while the adjacent flow passage formation bodies (e.g., first flow passage component 37 and second flow passage component 38) are clamped in the stacking direction. Thus, the manufacturing of the valve unit 22 is completed without waiting for the adhesive to dry and harden.

Figure 20:
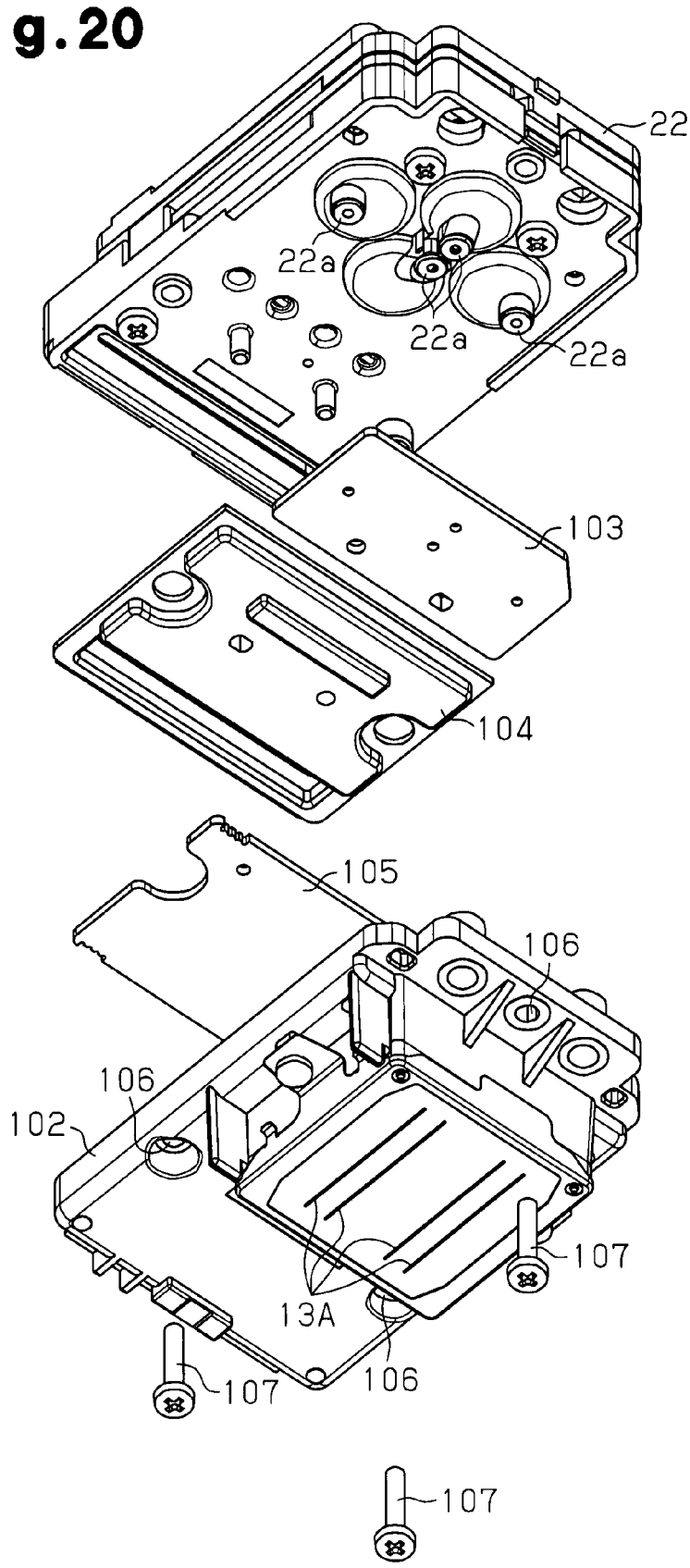
FIG. 20 is a perspective view showing the step of attaching a head case to the valve unit.
Figure 21:
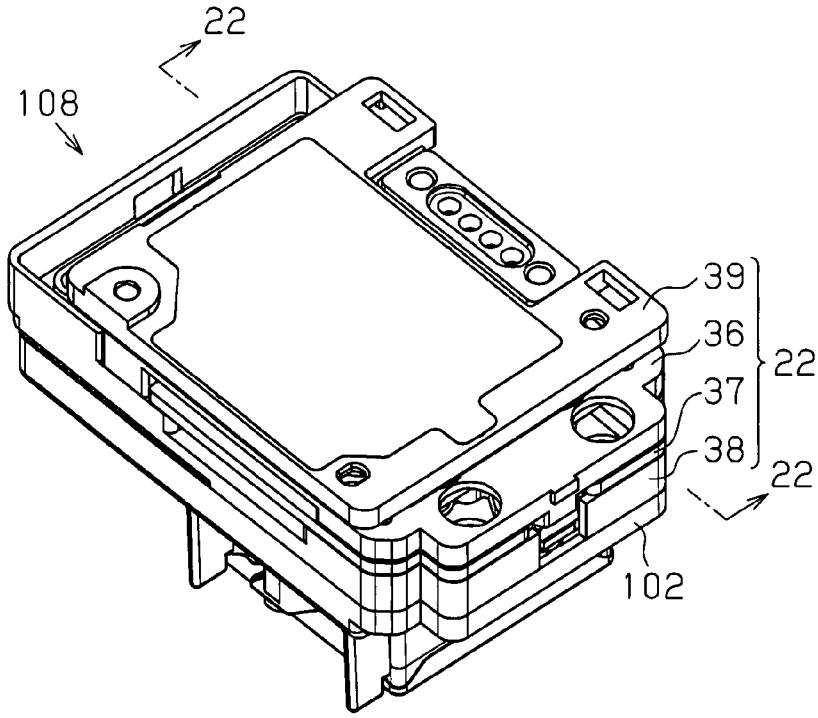
FIG. 21 is a perspective view showing the head unit of FIG. 1.

A head case 102 of the recording head 13 is then integrated with the completed valve unit 22. A head connection port rubber seal 103, a peripheral rubber seal 104, and a head base plate 105 are arranged on the rear surface of the valve unit 22, and the head case 102 is attached to the rear surface of the second flow passage component 38 from which the head connection ports 22*a* project, as shown in FIG. 20. At the same time, fastening screws 107 are inserted to a plurality of (three in the present embodiment) threaded holes 106 formed in the head case 102.

The distal ends of the fastening screws 107 are then extended through the threaded insertion holes 38*b* of the second flow passage component 38 and the threaded insertion holes 37*b* of the first flow passage component 37 and fastened to the hexagonal nuts (not shown) fitted into the nut receptacle 36*c* of the pressure chamber component 36. The head case 102 is fixed to the valve unit 22 by the fastening force of the fastening screws 107. This completes the head unit 108 shown in FIG. 21.

This manufactures the valve unit 22 including a plurality of liquid supply passages capable of supplying ink from the plurality of ink cartridges 16 to the recording head 13 with the plurality of nozzle rows 13A corresponding to the ink cartridges 16. In the present embodiment, the liquid supply passages in the valve unit 22 is formed by the conduit flow passages 50 (pressure chamber 50A), the ink flow passages 65*a* to 65*c*, 76*a* to 76*c*, and 87, and the recesses 66 to 69, 70 to 73, and 83.

Each liquid supply passage includes a common portion (e.g., conduit flow passage 50 (pressure chamber 50A), ink flow passage 76*a*, recesses 70 to 73 etc.) that are functionally in common with other liquid supply passages in the valve unit 22 of the present embodiment. The common portion of the plurality of liquid supply passages is formed in the same flow passage formation body (e.g., pressure chamber component 36, second flow passage component 38). Therefore, pressure fluctuations do not differ between the pressure chambers 50A in the plurality of liquid supply passages. The head unit 108 (valve unit 22) manufactured in this manner is then mounted on the carriage 14.

Figure 22:
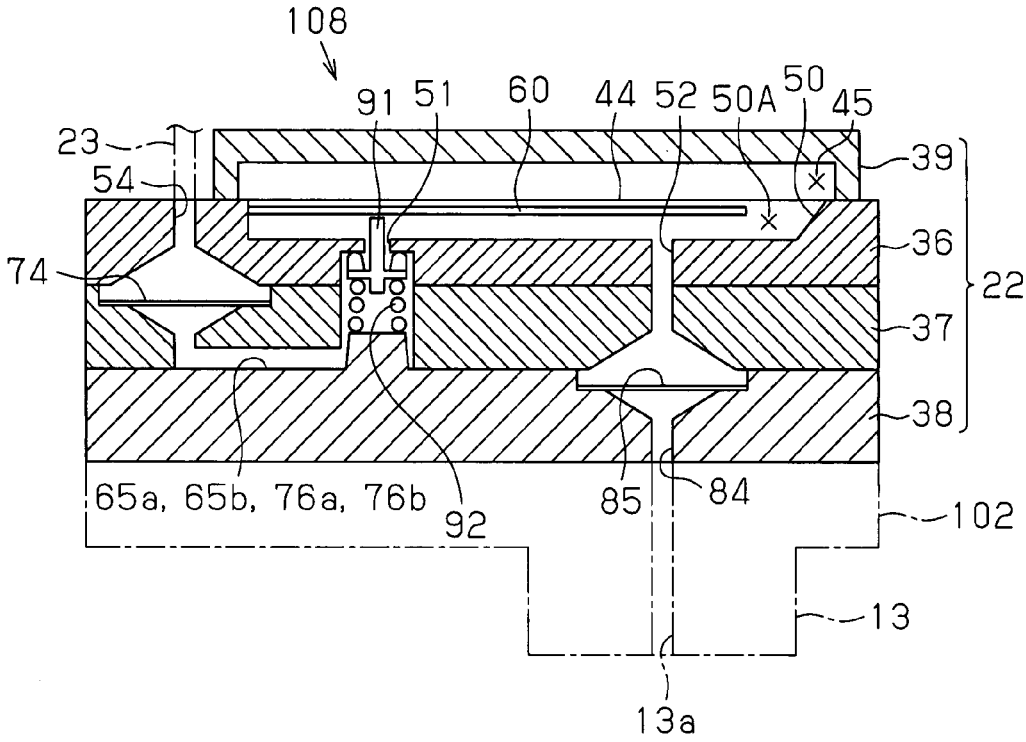
FIG. 22 is a schematic cross-sectional view taken along line 22-22 in FIG. 21.

The operation of the head unit 108 will now be described with reference to FIG. 22. FIG. 22 is a schematic diagram simply showing the ink supply state in the head unit 108, particularly, in the valve unit 22. Detailed parts of the valve unit 22 are partially omitted.

The ink supplied to the valve unit 22 through each ink supply tube 23 is temporarily stored in the pressure chamber 50A. Then, the ink is supplied to the corresponding nozzle row 13A (see FIG. 20) of the recording head 13 and ejected from the nozzle 13*a*. In a state in which ink is temporarily stored in the pressure chamber 50A, if ink flows out of the pressure chamber 50A into the recording head 13 via the exits 52 as ink is ejected from the nozzles 13*a*, pressure fluctuation (i.e., negative pressure) occurs in the pressure chamber 50A.

As a result, the seal film 44 is displaced so as to deform inward (downward in FIG. 2) into the pressure chamber 50A due to the generated negative pressure. This pushes the elastic strip (actuating lever) 60 into the pressure chamber 50A. Consequently, the elastic strip 60 pushes the movable valve 91, which is located at the valve close position shown in FIG. 22, downward (i.e., direction towards valve open position) against the urging force of the seal spring 92 to open the valve with actuation force obtained by increasing the displacement force of the seal film 44. As a result, the movable valve 91 opens the entrance 51 of the pressure chamber 50A, and ink flows into the pressure chamber 50A from the ink flow passages 65*a*, 65*b*, 76*a*, and 76*b*, which form part of the liquid supply passage in the valve unit 22, through the entrance 51.

The flow of the entering ink increases the pressure in the pressure chamber 50A and cancels the negative pressure state. Thus, the seal film 44 returns to its original form as shown in the state of FIG. 22. The elastic strip 60 also returns to its original form as shown in the state of FIG. 22. This moves the movable valve 91 again to the valve close position for closing the entrance 51 with the urging force of the seal spring 92. Accordingly, the flow of ink from the entrance 51 into the pressure chamber 50A is restricted.

If foreign matter is contained in the ink supplied from the ink supply tube 23 to the valve unit 22, such foreign matter is first captured by the inlet filter member 74. As a result, foreign matter does not reach the downstream side of the inlet filter member 74, and foreign matter is prevented from being caught in the seal portion 91*c* of the movable valve 91 and affecting sealing properties. Further, the temporary storage of ink and the supply of ink to the recording head 13 are performed while maintaining the environment in the pressure chamber 50A clean.

Fine foreign matter (e.g., less than 29 microns) that cannot be captured by the inlet filter member 74 passes through the movable valve 91 and reaches the pressure chamber 50A. However, such fine foreign material is captured by the outlet filter member 85 located downstream of the pressure chamber 50A. This prevents the nozzle 13*a* from being clogged by foreign matter.

Foreign matter may enter the head case 102 of the recording head 13 during the manufacturing stage. When such foreign matter is suspended in the ink supplied from the valve unit 22 to each nozzle row 13A through an ink flow passage (liquid supply passage), which is not shown in the drawings, in the head case 102, such foreign matter would clog the nozzles 13*a*. In such as case, the fastening screws 107 are removed to separate the head case 102 from the valve unit 22 in the present embodiment. Then, the ink flow passage in the head case 102 undergoes forcibly suction from the side opposite the nozzle 13*a* of the recording head 13, that is, from the upstream side in the ink flow direction, to reverse the flow of ink and reversely wash the recording head 13. A filter member is not arranged in the ink flow passage in the head case 102. This ensures that the foreign matter is discharged from the head case 102 with the ink reversely flowing through the ink flow passage when the above washing is performed.

The above embodiment has the advantages described below.

(1) The valve unit 22 supplies the ink from the plurality of ink cartridges 16 to the corresponding nozzle row 13A via the plurality of liquid supply passages corresponding to the plurality of ink cartridges 16. Each liquid supply passage includes a common portion (e.g., conduit flow passage 50 (pressure chamber 50A), ink flow passage 76*a*, recesses 70 to 73 etc.) that is functionally in common with other liquid supply passages. The common portion of the plurality of liquid supply passages is formed in the same flow passage formation body (e.g., pressure chamber component 36 and second flow passage component 38). This prevents the ink supplying function from varying between the liquid supply passages (e.g., between the pressure chambers 50A), and the ink supplying state becomes uniform.

(2) The plurality of pressure chambers (liquid storage unit) 50A, each forming part of a liquid supply passage, are formed in the same pressure chamber component (flow passage formation body) 36 and identically shaped. Thus, pressure fluctuations, which occur in the pressure chamber 50A when ink is ejected from the nozzle row 13A of the recording head 13, does not vary between the plurality of pressure chambers 50A. Accordingly, the state of the ink flowing out of the plurality of pressure chambers 50A to the recording head 13 is uniform.

(3) The plurality of pressure chambers 50A are formed by the plurality of conduit flow passages 50 extending parallel to each other. Thus, the plurality of pressure chambers 50A are formed in the same flow passage formation body (pressure chamber component 36 in the present embodiment) while saving space. This contributes to the miniaturization of the printer 10 compared to when the flow passage forming the pressure chamber is a circular flow passage or the like.

(4) The plurality of pressure chambers (liquid storage unit) 50A may be formed simultaneously just by covering the plurality of conduit flow passages 50 formed in the pressure chamber component 36, which is one of the flow passage formation bodies, with a single seal film 44. Therefore, the manufacturing efficiency of the valve unit 22 is improved compared to when using a strip of a seal film for each conduit flow passage 50.

(5) The movable valve (open/close valve) 91 is arranged at each entrance 51 of the plurality of pressure chambers 50A. However, the seal film 44 displaced to open the movable valve 91 is a single film member used commonly between each of the movable valves 91. Thus, the operation timing is prevented from varying between the plurality of movable valves 91. This aspect also contributes to making the state of the ink flowing out of the plurality of pressure chambers 50A to the recording head 13 uniform.

(6) The plurality of actuating levers for operating each of the plurality of movable valves 91 is formed by a plurality of elastic strips 60 extending from the single elastic plate 62. That is, the plurality of actuating levers corresponding to the plurality of movable valves 91 is prepared by simply attaching the single elastic member 62 to the pressure chamber component 36. This improves the manufacturing efficiency of the valve unit 22.

(7) The state of the ink supplied from the plurality of liquid supply passages (e.g., pressure chamber 50A) to the nozzle row 13A of the recording head 13 is uniformed. Thus, the state of the ink ejected from the plurality of nozzle rows 13A is prevented from varying between the nozzle rows 13A.

(8) Even if the adhesive between adjacent flow passage formation bodies is still not dry, the subsequent flow passage formation bodies can be adhered to each other one after another. That is, the screw member 101 serving as the pressure contact member holds the flow passage formation bodies so that they are not displaced or separated even if the adhesive is still not dried and hardened. Accordingly, the assembly of the valve unit 22 may be quickly completed without waiting for the adhesive to dry and harden. This improves the manufacturing efficiency of the printer 10 incorporating the valve unit 22.

(9) The plurality of flow passage formation bodies is rapidly and easily integrated by using the screw members 101, which are versatile products, in the manufacturing stage of the valve unit 22. The state of pressure contact between adjacent flow passage formation bodies is adjusted by adjusting the fastening force of the screw members 101.

(10) The integration of the flow passage formation bodies is completed by simply fastening the screw members 101 once even if there are many flow passage formation bodies forming the valve unit 22. This improves the manufacturing efficiency of the valve unit 22.

(11) The flow passage formation bodies adjacent in the stacking direction, such as the pressure chamber component 36 and the first flow passage component 37, are stacked in a satisfactory manner so that the outer contours are aligned when viewed from above by using the positioning function of the pilot holes 58 and 81 serving as the positioning portions.

(12) When the ink supplied from the valve unit 22 to the recording head 13 contains foreign matter, such foreign matter is captured by the outlet filter member 85 arranged in the liquid supply passage (recess 83) of in the valve unit 22. Thus, ink from which foreign matter is eliminated is supplied from the valve unit 22 to the recording head 13. If foreign matter is present in the ink flow passage (liquid supply passage) in the head case 102, such foreign matter is removed by reversely washing the recording head 13.

(13) If the ink supplied from the ink cartridge 16 to the valve unit 22 contains foreign matter, such foreign matter is captured and removed by the inlet filter member 74. This keeps the environment in the valve unit 22 (pressure chamber 50A etc.) clean. This reduces the possibility of foreign matter being caught in the seal portion 91*c* of the movable valve (open/close valve) 91, and the sealing function remains the same. Thus, the operation of the valve unit 22 is stabilized.

(14) Foreign matter that cannot be captured by the inlet filter member 74 is captured by the outlet filter member 85 arranged on the downstream side of the inlet filter member 74. Thus, clean ink, from which foreign matter is eliminated, is supplied to the recording head 13.

(15) The mesh roughness of the outlet filter member 85 is set so as to enable the capturing of foreign matter smaller than the diameter of the nozzles 13*a* of the recording head 13. This prevents the nozzles 13*a* from being clogged by foreign matter.

(16) Each of the filter members 74 and 85 is attached to one of the flow passage formation bodies at a predetermined location (recess 70 to 73, 83) before stacking the flow passage formation bodies. Accordingly, the attachment of the filter members 74 and 85 is significantly simplified.

The above embodiment may be modified to different embodiments as described below.

In the above embodiment, each of the filter members 74 and 85 may be press-fitted to and attached to the liquid inlets 54 or the liquid outlets 84 in the valve unit 22.

In the above embodiment, the mesh roughness of each of the inlet filter members 74 and the outlet filter members 85 may be the same. Alternately, the mesh roughness may have any value differing from that of the above embodiment (29 microns, 19 microns).

In the above embodiment, instead of metal mesh, each of the filter members 74 and 85 may be made of non-woven cloth, glass fiber, or the like.

In the above embodiment, the inlet filter members 74 may be eliminated from the valve unit 22 so that only the outlet filter members 85 are attached to the valve unit 22. In this case, foreign material can be eliminated from the inside of the recording head 13 by reversely washing the recording head 13.

In the above embodiment, the protection plate 39, the pressure chamber component 36, the first flow passage component 37, and the second flow passage component 38 may each be divided into four flow passages. Each of the quarterly-divided flow passage formation body may be stacked to form units of single flow passages, thereby forming four valve units. In such a structure, the valve unit can be readily manufactured in units of single flow passages without waiting for the adhesive to dry and harden.

In the above embodiment, the pilot holes 39*a*, 58, 81 serving as the positioning portions do not necessarily need to be arranged in the valve unit 22.

In the above embodiment, the screw members 101, serving as the pressure contact members may hold only two of the flow passage formation bodies that are adjacent in the stacking direction in a clamped state with the screw fastening force. In this case, however, the screw member 101 that becomes necessary increases as the number of flow passage formation bodies that are stacked increases.

In the above embodiment, the pressure contact member may be a clip device or a pressing device in lieu of the screw members 101.

In the above embodiment, the plurality of elastic strips 60 forming the actuating levers may each be an elastic member of a simple structure.

In the above embodiment, the elastic plate 62 may be eliminated, and a pressure receiving plate may be attached to the seal film 44 so that the pressure receiving plate opens the movable valve 91 when the seal film 44 is displaced.

In the above embodiment, the seal film 44 may be a plurality of film strips respectively corresponding to the plurality of conduit recesses 42.

In the above embodiment, the flow passage of the valve unit 22 forming the pressure chamber 50A is not limited to the conduit flow passages 50 and may be a circular hole.

The valve unit 22 does not necessarily need to be formed by stacking the plurality of flow passage formation bodies as long as the common portion of the plurality of the liquid supply passages is formed in the same flow passage formation body, and the valve unit 22 may be formed by a single flow passage formation body.

A printer (printing device including facsimile, copier etc.) for ejecting ink has been described as the liquid ejection apparatus in the above embodiment. However, the printer may be a liquid ejection apparatus that ejects other liquids. The liquid ejection apparatus according to the present invention may be applied to an apparatus for manufacturing a liquid crystal display, plasma display, organic EL display, an FED (field emission display), or the like. The liquid ejection apparatus discharges various materials such as a coloring material for forming a pixel forming region, electrode forming region, or the like or liquid for an electrode or the like. The liquid ejection apparatus of the present invention may be applied to a liquid ejection apparatus for ejecting liquid containing bioorganic substance used in manufacturing bio chips.

What is claimed is:

1. A liquid supplying device for supplying liquid that is supplied from a plurality of liquid containers to a liquid ejection head including a plurality of nozzle rows respectively corresponding to the plurality of liquid containers, the liquid supplying device comprising:

a plurality of liquid supply passages, each of the liquid supply passages being capable of supplying liquid supplied from a corresponding one of the liquid containers to a corresponding one of the nozzle rows, wherein each of the liquid supply passages includes a common portion that is functionally in common with another one of the liquid supply passages; and at least one flow passage formation body, the common portions of the plurality of liquid supply passages being formed in the same flow passage formation body, wherein:

a plurality of liquid storage units for temporarily storing liquid supplied from a corresponding one of the liquid containers are respectively formed in the plurality of liquid supply passages, the plurality of liquid storage units being formed in the same flow passage formation body so as to be shaped identically;

each of the plurality of liquid storage units causes stored liquid to flow out into the liquid ejection head based on a pressure fluctuation in the liquid storage unit that occurs when liquid is ejected from a corresponding one of the nozzle rows;

the plurality of liquid storage units are formed by a plurality of conduit flow passages extending parallel to each other;

each of the conduit flow passages includes an opening that opens in one surface of the at least one flow passage formation body, and each liquid storage unit is formed by attaching a film member to the one surface of the at least one flow passage formation body so as to seal the opening of each conduit flow passage;

the film member is displaceable in accordance with the pressure in each liquid storage unit, and each of the liquid storage units includes a liquid entrance and a liquid exit, with an open/close valve arranged in each liquid entrance and operated based on displacement of the film member;

when the film member is displaced by negative pressure generated in at least one of the liquid storage units as liquid flows out of the liquid exit thereof, displacement of the film member is transmitted to the open/close valve of the at least one of the liquid storage units and the open/close valve of the at least one of the liquid storage units opens the liquid entrance of the at least one of the liquid storage units; and a plurality of actuating levers are supported in a cantilevered manner by the at least one flow passage formation body so as to be respectively arranged in the liquid storage units, each actuating lever pushing a respective open/close valve in a valve opening direction with an actuation force obtained by increasing displacement force of the film member when the film member is displaced inward into a liquid storage unit, and the plurality of actuating levers being arranged on a single elastic plate in a comb-shaped manner.

* * * * *